US009650207B2

(12) United States Patent
Nakayama et al.

(10) Patent No.: US 9,650,207 B2
(45) Date of Patent: May 16, 2017

(54) CYLINDRICAL BOTTLE WITH BOTTOM

(75) Inventors: Tadayori Nakayama, Tokyo (JP); Takao Iizuka, Matsudo (JP); Goro Kurihara, Tokyo (JP); Hiroaki Imai, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 13/823,552

(22) PCT Filed: Sep. 22, 2011

(86) PCT No.: PCT/JP2011/071577
§ 371 (c)(1),
(2), (4) Date: Mar. 14, 2013

(87) PCT Pub. No.: WO2012/043362
PCT Pub. Date: Apr. 5, 2012

(65) Prior Publication Data

US 2013/0180998 A1 Jul. 18, 2013

(30) Foreign Application Priority Data

Sep. 30, 2010 (JP) ..... 2010-220704
Nov. 30, 2010 (JP) ..... 2010-267385

(51) Int. Cl.
*B65D 79/00* (2006.01)
*B65D 1/02* (2006.01)
*B65D 90/36* (2006.01)

(52) U.S. Cl.
CPC ..... *B65D 90/36* (2013.01); *B65D 1/0261* (2013.01); *B65D 1/0276* (2013.01);
(Continued)

(58) Field of Classification Search
CPC ..... B65D 79/005; B65D 1/0276
(Continued)

(56) References Cited

U.S. PATENT DOCUMENTS 4,785,949 A * 11/1988 Krishnakumar et al. ..... 215/375
5,503,283 A * 4/1996 Semersky ..... 215/375
(Continued)

FOREIGN PATENT DOCUMENTS

CN 101084149 A 12/2007
JP A-62-235041 10/1987
(Continued)

OTHER PUBLICATIONS

Dec. 13, 2011 International Search Report issued in International Application No. PCT/JP2011/071577 (with translation).
(Continued)

*Primary Examiner* — Jeffrey Allen
*Assistant Examiner* — Jennifer Castriotta
(74) *Attorney, Agent, or Firm* — Oliff PLC

(57) ABSTRACT

A bottle is a bottle formed of synthetic resin materials in a cylindrical shape with a bottom. A bottom wall portion in a bottom portion thereof includes a grounding portion positioned at an outer circumferential edge thereof, a rising circumferential wall portion connected to the grounding portion from an inside of a bottle radial direction and extending upward, a movable wall portion protruding from an upper end part of the rising circumferential wall portion toward the inside of the bottle radial direction, and a recessed circumferential wall portion extending upward from an inner end part in the bottle radial direction of the movable wall portion. The movable wall portion is arranged to be movable upward together with the recessed circumferential wall portion, around a connected portion with the rising circumferential wall portion. A plurality of ribs are arranged in the movable wall portion radially around a bottle axis.

5 Claims, 4 Drawing Sheets

(52) U.S. Cl.
CPC ..... *B65D 1/0284* (2013.01); *B65D 79/005* (2013.01); *B65D 2501/0036* (2013.01)

(58) Field of Classification Search
USPC ..... 220/609, 606, 635, 636; 215/371, 372, 215/373
See application file for complete search history.

(56) References Cited

U.S. PATENT DOCUMENTS

| | | | | |
|---|---|---|---|---|
| 6,065,624 | A * | 5/2000 | Steinke | 215/383 |
| 6,634,517 | B2 * | 10/2003 | Cheng et al. | 215/373 |
| 2007/0084821 | A1 | 4/2007 | Bysick et al. | |
| 2009/0090728 | A1 * | 4/2009 | Trude et al. | 220/609 |
| 2009/0159556 | A1 * | 6/2009 | Patcheak et al. | 215/373 |
| 2009/0242575 | A1 * | 10/2009 | Kamineni et al. | 220/608 |
| 2011/0233166 | A1 | 9/2011 | Hiromichi et al. | |

FOREIGN PATENT DOCUMENTS

| | | |
|---|---|---|
| JP | A-7-112729 | 5/1995 |
| JP | A-2007-290772 | 11/2007 |
| JP | A-2010-126184 | 6/2010 |
| WO | WO 2006/068511 A1 | 6/2006 |
| WO | WO 2010/061758 A1 | 6/2010 |

OTHER PUBLICATIONS

May 30, 2014 Office Action issued Chinese Patent Application No. 201180045761.3 (with partial English translation).
Aug. 31, 2015 Office Action issued in Taiwanese Patent Application No. 100134661.

* cited by examiner

CYLINDRICAL BOTTLE WITH BOTTOM

TECHNICAL FIELD

The present invention relates to a bottle.

Priority is claimed on Japanese Patent Application No. 2010-220704, filed on Sep. 30, 2010, and Japanese Patent Application No. 2010-267385, filed on Nov. 30, 2010, the contents of which are incorporated herein by reference.

BACKGROUND ART

In the related art, as a bottle formed of synthetic resin materials in a cylindrical shape with a bottom, for example, a structure disclosed in Patent Document 1 noted below is known. A bottom wall portion in a bottom portion of this bottle includes a grounding portion positioned at the outer circumferential edge thereof, a rising circumferential wall portion connected to the grounding portion from the inside of a bottle radial direction and extending upward, a movable wall portion protruding from the upper end part of the rising circumferential wall portion toward the inside of the bottle radial direction, and a recessed circumferential wall portion extending upward from the inner end part in the bottle radial direction of the movable wall portion. The movable wall portion moves rotationally around a connected portion with the rising circumferential wall portion so as to move the recessed circumferential wall portion upward, thereby absorbing pressure reduction inside the bottle.

DOCUMENT OF RELATED ART

Patent Document

[Patent Document 1] PCT International Publication No. WO 2010/061758

SUMMARY OF INVENTION

Technical Problem

However, the bottle in the related art has room for improvement in the pressure reduction-absorbing performance of the bottle.

The present invention has been made in view of the above circumstances, and aims to provide a bottle capable of improving the pressure reduction-absorbing performance in the bottle.

Solution to Problem

The present invention provides the following means in order to solve the above problems.

A bottle in the present invention is formed of synthetic resin materials in a cylindrical shape with a bottom, and includes a bottom wall portion in a bottom portion thereof. The bottom wall portion includes: a grounding portion positioned at an outer circumferential edge thereof; a rising circumferential wall portion connected to the grounding portion from an inside of a bottle radial direction, the rising circumferential wall portion extending upward; a movable wall portion protruding from an upper end part of the rising circumferential wall portion toward the inside of the bottle radial direction; and a recessed circumferential wall portion extending upward from an inner end part in the bottle radial direction of the movable wall portion. The movable wall portion is arranged to be movable upward together with the recessed circumferential wall portion, around a connected portion with the rising circumferential wall portion. In addition, a plurality of ribs are arranged in the movable wall portion radially around a bottle axis.

According to the present invention, the plurality of ribs are formed in the movable wall portion in the bottom wall portion, whereby the surface area of the movable wall portion can be increased. Thereby, since the pressure-receiving area in the movable wall portion is increased, the movable wall portion is deformed immediately in response to pressure changes inside the bottle. Thus, the pressure reduction-absorbing performance of the bottle can be improved.

In addition, the ribs are arranged radially around the bottle axis, whereby the entire area of the movable wall portion can be deformed uniformly, and the pressure reduction-absorbing performance can be improved further.

Each rib may extend discontinuously in the bottle radial direction.

In this case, each rib is formed discontinuously in the bottle radial direction, whereby the surface area of each rib can be increased effectively. Thereby, the pressure-receiving area in the movable wall portion can be increased further. In addition, by forming each rib discontinuously, since the movable wall portion is easily deformed not only in the circumferential direction but also in the radial direction, the movable wall portion can be flexibly deformed in response to pressure changes inside the bottle.

Each rib is preferably formed in a concave shape recessed upward.

In this case, since each rib is formed in a concave shape recessed in an upper direction as the deformation direction of the movable wall portion at the time of pressure reduction, the movable wall portion can be reliably deformed in response to pressure changes inside the bottle.

A ratio of a width of each rib in a circumferential direction around the bottle axis, to an outermost circumferential length in the radial direction between ribs adjacent to each other in the circumferential direction in the movable wall portion, is preferably larger than or equal to 0.12.

As deformation processes in the movable wall portion at the time of bottle pressure reduction, it is thought that a large stress is applied locally to a part of the movable wall portion (for example, the stress is applied to one of the ribs formed radially, or to the vicinity of the one), and the stress is transferred to the adjacent rib, whereby the movable wall portion is deformed in reverse over the entire circumference thereof. The ratio of the width of each rib in the circumferential direction, to the outermost circumferential length in the radial direction between ribs adjacent to each other in the circumferential direction in the movable wall portion, is larger than or equal to 0.12, whereby the distance between the ribs adjacent to each other in the circumferential direction can be reduced relatively. Thereby, since a local stress can be reliably transferred to the adjacent rib, the movable wall portion can be reliably deformed in reverse over the entire circumference thereof, and the pressure reduction-absorbing performance can be exerted reliably.

Effects of Invention

According to the present invention, the pressure reduction-absorbing performance of the bottle can be improved.

DESCRIPTION OF EMBODIMENTS

A bottle in an embodiment of the present invention is described below with reference to the drawings.

Figure 1:
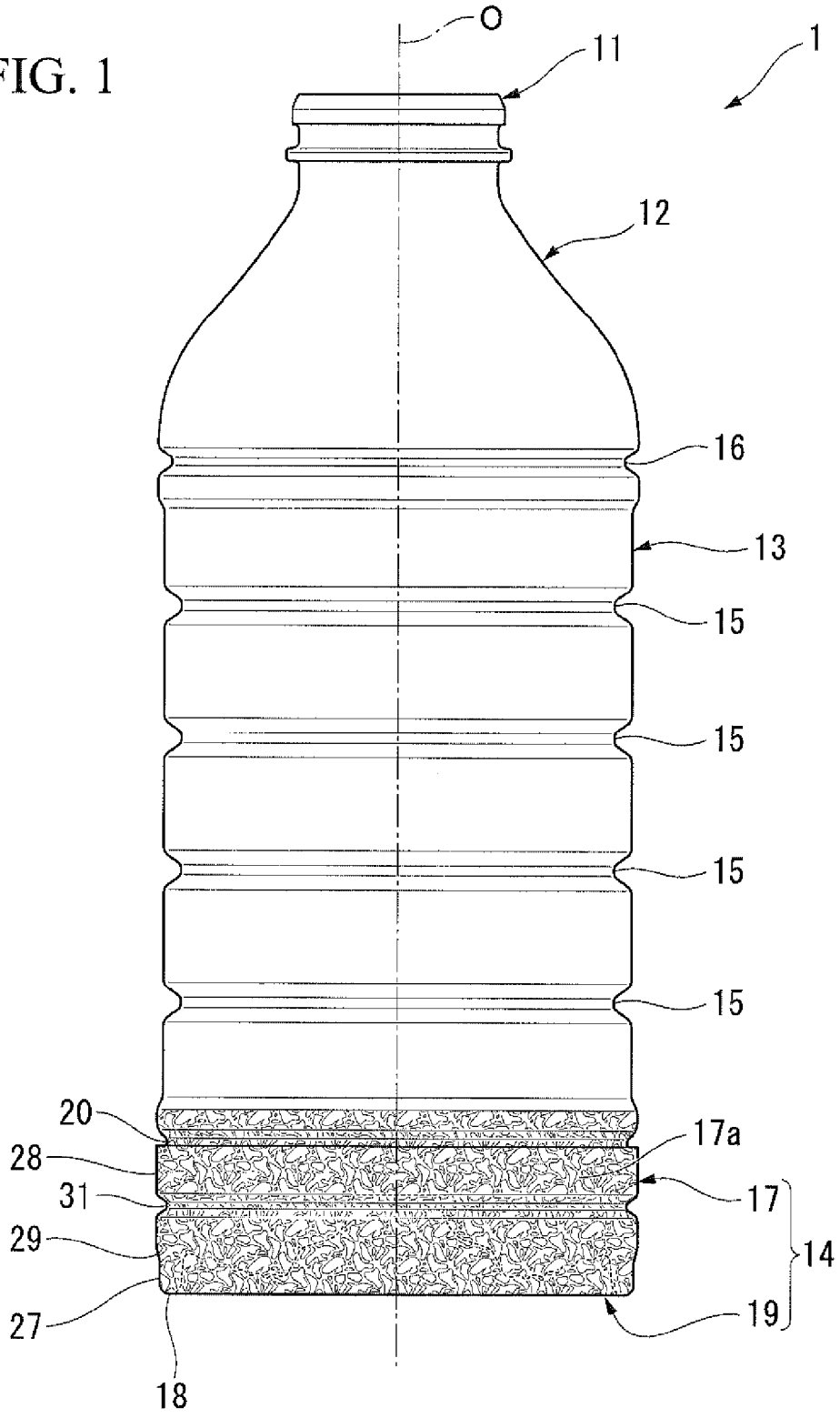
FIG. 1 is a side view of a bottle in an embodiment of the present invention.

As shown in FIG. 1, a bottle 1 in the embodiment includes a mouth portion 11, a shoulder portion 12, a body portion 13, and a bottom portion 14. The bottle 1 has a structure in which the mouth portion 11, the shoulder portion 12, the body portion 13, and the bottom portion 14 are provided in series so as to dispose each central axis thereof on a common axis.

Hereinafter, a bottle axis O represents the above common axis, and an upper side and a lower side respectively represent the mouth portion 11 side and the bottom portion 14 side in the bottle axis O direction. A radial direction represents a direction orthogonal to the bottle axis O, and a circumferential direction represents a direction going around the bottle axis O.

A preform formed in a cylindrical shape with a bottom by injection molding is blow-molded, whereby the bottle 1 is integrally formed of synthetic resin materials. A cap (not shown) is provided on the mouth portion 11. Each of the mouth portion 11, the shoulder portion 12, the body portion 13, and the bottom portion 14 is formed so that a cross-sectional shape thereof in a direction orthogonal to the bottle axis O is a circular shape.

A first annular groove 16 is formed in a connected portion between the shoulder portion 12 and the body portion 13, continuously over the entire circumference thereof.

The body portion 13 is formed in a cylindrical shape. A part between both end parts of the body portion 13 in the bottle axis O direction has a smaller diameter than that of each end part. A plurality of second annular grooves 15 are formed in the body portion 13 so as to be separated from each other in the bottle axis O direction, each continuously over the entire circumference thereof.

A third annular groove 20 is formed in a connected portion between the body portion 13 and the bottom portion 14, continuously over the entire circumference thereof.

The bottom portion 14 is formed in a cup shape including a cylindrical heel portion 17 in which an upper opening section thereof is connected to a lower opening section of the body portion 13, and a bottom wall portion 19 which closes a lower opening section of the heel portion 17 and in which the outer circumferential edge thereof constitutes a grounding portion 18.

A fourth annular groove 31 having the same depth as that of the third annular groove 20 is formed in the heel portion 17 continuously over the entire circumference thereof.

In this embodiment, an uneven portion 17*a* is formed on an outer circumferential surface of the heel portion 17 and an outer circumferential surface in a lower end part of the body portion 13. This prevents the deterioration of slipperiness due to direct contact of outer circumferential surfaces with each other of heel portions 17 of bottles 1 adjacent to each other, or due to direct contact of outer circumferential surfaces with each other in lower end parts of body portions 13, when a plurality of erected bottles 1 are conveyed in a filling step (step in which a bottle is filled with contents). Thereby, so-called blocking is prevented from being caused. In addition, in this embodiment, the uneven portion 17*a* is also formed on a surface of the third annular groove 20 and a surface of the fourth annular groove 31.

Figure 3:
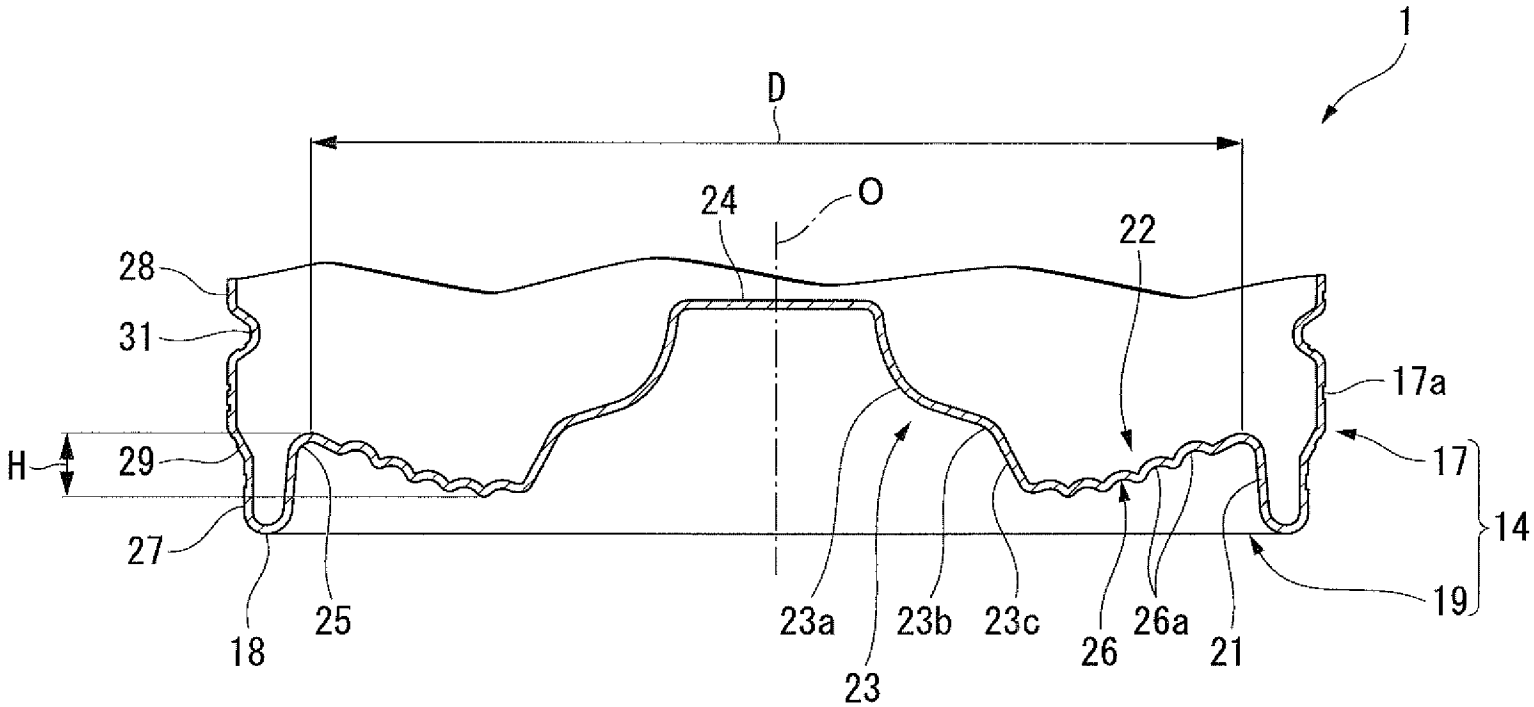
FIG. 3 is a cross-sectional view along line A-A in FIG. 2.

As shown in FIG. 3, the bottom wall portion 19 includes a rising circumferential wall portion 21 connected to the grounding portion 18 from the inside of the radial direction and extending upward, an annular movable wall portion 22 protruding from the upper end part of the rising circumferential wall portion 21 toward the inside of the radial direction, and a recessed circumferential wall portion 23 extending upward from the inner end part in the radial direction of the movable wall portion 22.

The rising circumferential wall portion 21 has a smaller diameter gradually as proceeding upward from downward.

The movable wall portion 22 is formed in a curved surface shape protruding downward, and extends downward gradually as proceeding to the inside from the outside in the radial direction. The movable wall portion 22 and the rising circumferential wall portion 21 are connected to each other through a curved surface part 25 protruding upward. The movable wall portion 22 is configured to be movable rotationally around the curved surface part 25 (connected portion with the rising circumferential wall portion 21) so as to move the recessed circumferential wall portion 23 upward. The vertical interval H of the movable wall portion 22 (the height thereof in the bottle axis O direction, that is, the length from the vicinity of a connected portion with the recessed circumferential wall portion 23, to the curved surface part 25 in the bottle axis O direction) is set at 5% or larger of the diameter D of the movable wall portion 22 ($H/D \geq 0.05$). Thereby, the movable wall portion 22 can be easily moved (rotated), and a moving distance of the movable wall portion 22 can be secured largely.

Figure 2:
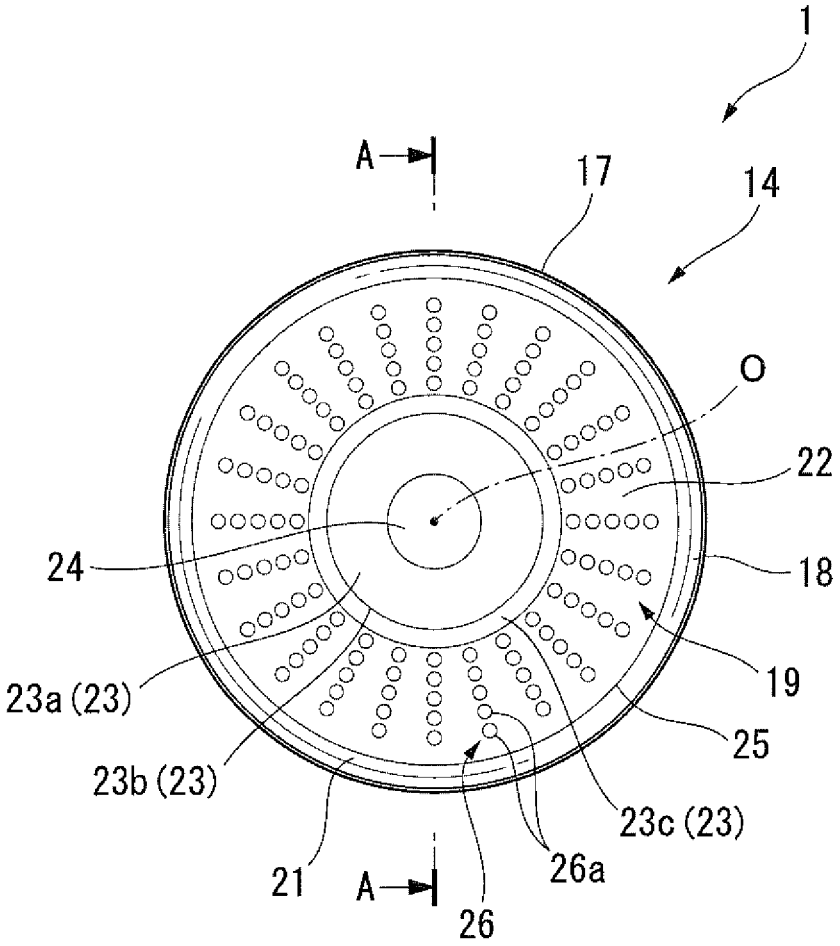
FIG. 2 is a bottom view of the bottle in the embodiment of the present invention.

As shown in FIGS. 2 and 3, a plurality of ribs 26 are arranged in the movable wall portion 22 radially around the bottle axis O. The ribs 26 are arranged at regular intervals in the circumferential direction. Each rib 26 is composed of a plurality of recesses 26*a* each recessed upward in a curved surface shape. A part of the movable wall portion 22 protrudes upward in a hemispherical shape, whereby each recess 26*a* is formed. The plurality of recesses 26*a* are arranged in the radial direction. That is, each rib 26 is formed so as to extend discontinuously in a straight line in the radial direction. Thereby, each rib 26 has a longitudinal cross-sectional shape in the radial direction formed in a waveform (see FIG. 3).

The recesses 26*a* are each formed in the same shape and the same size, and are arranged at regular intervals in the radial direction. The arrangement positions of the recesses 26*a* in the radial direction are the same in each rib 26. The recess 26*a* positioned outermost in the radial direction in the plurality of recesses 26*a* is close to the curved surface part 25 from the inside in the radial direction, and the recess 26*a* positioned innermost in the radial direction is close to the recessed circumferential wall portion 23 from the outside in the radial direction.

The recessed circumferential wall portion 23 is arranged in an annular shape coaxial with the bottle axis O, and has a larger diameter gradually as proceeding downward from upward. A top wall 24 formed in a circular plate shape coaxial with the bottle axis O is connected to the upper end part of the recessed circumferential wall portion 23. The combination of the recessed circumferential wall portion 23 and the top wall 24 is formed in a cylindrical shape with a top. The recessed circumferential wall portion 23 has a lateral cross-sectional shape in a direction orthogonal to the bottom axis O formed in a circular shape. The recessed circumferential wall portion 23 includes a curved wall 23*a* formed in a curved surface shape protruding toward the inside in the radial direction, and an inclined wall 23*c* connected to the curved wall 23*a* through a bent part 23*b* bent downward from the lower edge of the curved wall 23*a*. The upper edge of the curved wall 23*a* is connected to the top wall 24. The inclined wall 23*c* has a larger diameter gradually as proceeding downward from upward, and the lower edge thereof is connected to the inner end part in the radial direction of the annular movable wall portion 22.

In this embodiment, a lower heel edge portion 27 in the heel portion 17 is connected to the grounding portion 18 from the outside in the radial direction, and is formed so as to have a smaller diameter than that of an upper heel portion 28 positioned at the upper side in the heel portion 17. The upper heel portion 28 constitutes the largest diameter part of the bottle 1, similarly to both end parts in the bottle axis O direction of the body portion 13 (see FIG. 1).

Furthermore, in this embodiment, a connection part 29 between the lower heel edge portion 27 and the upper heel portion 28 has a smaller diameter gradually as proceeding downward from upward. The longitudinal cross-sectional shape of the connection part 29 extends downward from upward in a straight line.

When the inside of the bottle 1 configured like this is depressurized, since the bottom wall portion 19 is applied with a pressure inward from outward of the bottle 1, the movable wall portion 22 moves upward, rotationally around the curved surface part 25 in the bottom wall portion 19. Accordingly, the movable wall portion 22 moves so as to lift the recessed circumferential wall portion 23 upward. The bottom wall portion 19 of the bottle 1 is actively deformed at the time of pressure reduction, whereby pressure changes (pressure reduction) inside the bottle 1 can be absorbed without deforming the body portion 13 or the like. In addition, the connected portion between the rising circumferential wall portion 21 and the movable wall portion 22 is formed as the curved surface part 25 protruding upward, whereby the movable wall portion 22 can be easily moved (rotated) around the upper end part of the rising circumferential wall portion 21. Accordingly, the movable wall portion 22 can be flexibly deformed based on the pressure changes inside the bottle 1.

Particularly, in this embodiment, since the plurality of ribs 26 are formed in the movable wall portion 22 in the bottom wall portion 19, the surface area of the movable wall portion 22 can be increased. Thereby, since the pressure-receiving area in the movable wall portion 22 is increased, the movable wall portion 22 is deformed immediately in response to the pressure changes inside the bottle 1. Thus, the pressure reduction-absorbing performance of the bottle 1 can be improved.

Since the ribs 26 in this embodiment are arranged radially around the bottle axis O, the entire area of the movable wall portion 22 can be deformed uniformly. Thereby, the pressure reduction-absorbing performance can be improved further.

Since each rib 26 in this embodiment is composed of the plurality of recesses 26*a* and is formed so as to extend discontinuously in the radial direction, the surface area of each rib 26 can be effectively increased. Thereby, the pressure-receiving area of the movable wall portion 22 can be increased further. In addition, each rib 26 is formed discontinuously, whereby the movable wall portion 22 is easily bent not only in the circumferential direction but also in the radial direction. As a result, the movable wall portion 22 can be further flexibly deformed based on the pressure changes inside the bottle 1.

Since each rib 26 (each recess 26*a*) is formed in a concave shape recessed in the upper direction in which the movable wall portion 22 is deformed at the time of pressure reduction, the movable wall portion 22 can be reliably deformed in response to the pressure changes inside the bottle 1.

Figure 4:
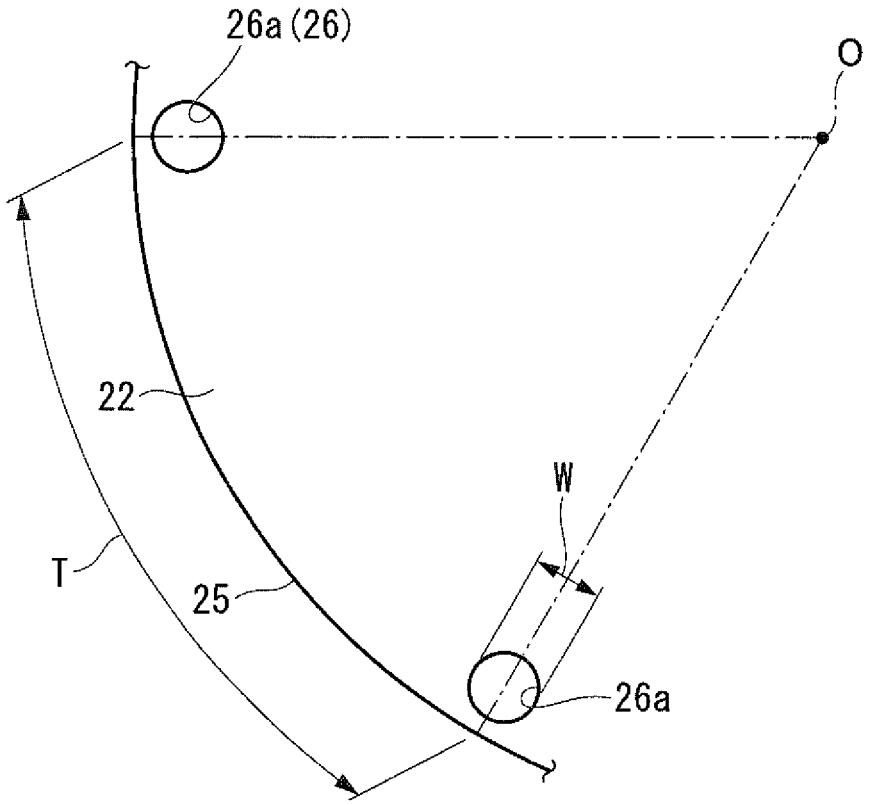
FIG. 4 is an enlarged view of a bottom surface of the bottle.

As shown in FIG. 4, the inventor of the present invention changed the ratio (hereinafter, the rib width ratio K=W/T) of the width W of a rib 26 in the circumferential direction (the diameter of a recess 26*a*), to the circumferential length T outermost in the radial direction (the connected portion to the curved surface part 25) between the central parts of ribs 26 adjacent to each other in the circumferential direction. In addition, the inventor analyzed how the relationship between the pressure reduction intensity (kPa) and the absorbing capacity (ml) is changed under each condition.

All the recesses 26*a* in this analysis were formed in hemispherical shapes having the same shape and the same size. In addition, in a case where the rib 26 was formed so as to extend continuously in the radial direction, the width thereof in the circumferential direction was used as the rib width W, and this rib width W was set at a fixed size.

In this analysis, the circumferential length T between the central parts of the ribs 26 adjacent to each other was changed by changing the number of ribs 26 formed radially in the movable wall portion 22 without changing the width W of each rib 26, whereby the rib width ratio K was changed. The used specific conditions are shown as Practical Examples 1 to 3 and Comparative Examples 1, 2 described below. In addition, the bottle used in this analysis was the bottle 1 in the embodiment described above, and the capacity therein was 500 ml.

<Practical Example 1> 8 ribs (the rib width ratio K=0.132)

<Practical Example 2> 12 ribs (the rib width ratio K=0.198)

<Practical Example 3> 24 ribs (the rib width ratio K=0.396)

<Comparative Example 1> 6 ribs (the rib width ratio K=0.099)

<Comparative Example 2> 7 ribs (the rib width ratio K=0.116)

First, in any case of the Practical Examples 1 to 3 and the Comparative Examples 1, 2, while the inside of the bottle 1 was depressurized, it was recognized that the pressure reduction-absorbing capacity (lost capacity by reducing the internal volume of the bottle 1) was increased in accordance with increase of the pressure reduction intensity. It is thought that this is because the movable wall portion 22 at least partly moved rotationally around the upper end part of the rising circumferential wall portion 21 by pressure reduction inside the bottle 1, and thereby the movable wall portion 22 moved so as to lift the recessed circumferential wall portion 23 upward.

Thereafter, when the pressure reduction intensity was increased further, in a case of the Practical Examples 1 to 3, it was recognized that the pressure reduction-absorbing capacity was increased suddenly in the middle of increasing the pressure reduction intensity. It is thought that this is because a large stress was applied locally to a part of the movable wall portion 22 when the bottle was depressurized (for example, the stress was applied to one of the ribs 26 formed radially, or to the vicinity of the one), and the stress was transferred to the adjacent rib 26, whereby the movable wall portion 22 was deformed in reverse over the entire circumference thereof. Like this, in the Practical Examples 1 to 3, it is thought that the upward moving distance of the movable wall portion 22 was increased suddenly by deforming the entire movable wall portion 22 in reverse, and the recessed circumferential wall portion 23 was moved upward further along with this, whereby the pressure reduction-absorbing capacity was increased suddenly.

On the other hand, in the Comparative Example 1 or 2, even when the pressure reduction intensity was increased further, the movable wall portion 22 was not entirely deformed in reverse, and it was not recognized that the pressure reduction-absorbing capacity was increased suddenly. In this case, it is thought that the body portion 13 or the like of the bottle 1 may be deformed before the movable wall portion 22 is deformed in reverse.

From the above, in order to reliably exert the pressure reduction-absorbing performance by reverse deformation of the movable wall portion 22, it is preferable that the number of the ribs 26 be many relatively, that is, the distance between ribs 26 adjacent to each other in the circumferential direction be short relatively. According to the above analysis result, the ratio of the width W in the circumferential direction of each rib 26 (the diameter of recess 26*a*), to the circumferential length T outermost in the radial direction (the connected portion to the curved surface part 25) between the central parts of ribs 26 adjacent to each other in the circumferential direction in the movable wall portion 22, is preferably higher than or equal to 0.12 (the rib width ratio K>0.12).

According to this structure, since the distance between the ribs 26 adjacent to each other in the circumferential direction can be short relatively, the local stress can be reliably transferred to the adjacent rib 26. Therefore, the movable wall portion 22 can be reliably deformed in reverse over the entire circumference thereof, and the pressure reduction-absorbing performance can be exerted reliably.

Though the embodiment of the present invention has been described in detail with reference to the drawings, the specific configurations of the present invention are not limited to this embodiment, and include modifications within the scope of the present invention.

For example, in the above embodiment, the ribs 26 extend radially and discontinuously. However, not limited to this, the ribs may extend continuously, or may extend so as to be curved.

The shape of the recess 26*a* is not limited to a circular shape in plan view, and can be changed suitably. For example, an oval shape, a rectangular shape or the like may be used. Further, the size of the recess 26*a* can be changed. In this case, the arrangement of the recesses 26*a* can be changed suitably. For example, the recesses 26*a* may be arranged so as to further enlarge the size thereof gradually as proceeding outward from inward in the radial direction.

In a case where the rib 26 is provided continuously, the width thereof may be changed. For example, the width of the rib 26 may be changed further as proceeding outward from inward in the radial direction.

The structure of the rising circumferential wall portion 21 can be changed suitably. For example, the rising circumferential wall portion 21 may extend parallel to a line in the bottle axis O direction.

The structure of the movable wall portion 22 can be changed suitably. For example, the movable wall portion 22 may protrude parallel to a line in the bottle radial direction.

The structure of the recessed circumferential wall portion 23 can be changed suitably. For example, the recessed circumferential wall portion 23 may extend parallel to a line in the bottle axis O direction.

The uneven portion 17*a* may not be formed.

The synthetic resin materials forming the bottle 1 can be changed suitably. For example, polyethylene terephthalate, polyethylene naphthalate, amorphous polyester, blend materials thereof or the like may be used.

The bottle 1 is not limited to a single-layer structure, and may be a laminated structure including an intermediate layer. As the intermediate layer, a layer formed of resin materials having a gas barrier property, a layer formed of recycled materials, a layer formed of resin materials having an oxygen-absorbing property or the like can be used.

In the above embodiment, a lateral cross-sectional shape of each of the shoulder portion 12, the body portion 13 and the bottom portion 14 in a direction orthogonal to the bottle axis O is formed in a circular shape. However, not limited to this, the structures thereof can be changed suitably, and may be a polygonal shape or the like.

Within the scope of the present invention, an element in the above embodiment may be suitably replaced with a well-known element, and the above modifications may be combined suitably.

INDUSTRIAL APPLICABILITY

The present invention can be widely applied to a bottle formed of synthetic resin materials in a cylindrical shape with a bottom.

The invention claimed is:

1. A bottle formed of synthetic resin materials in a cylindrical shape with a bottom, the bottle comprising:

a bottom wall portion in a bottom portion thereof including:

a grounding portion positioned at an outer circumferential edge thereof;

a rising circumferential wall portion connected to the grounding portion from inside thereof in a bottle radial direction orthogonal to a central axis of the bottle, the rising circumferential wall portion extending upward;

a movable wall portion protruding from an upper end part of the rising circumferential wall portion toward the central axis; and an annular recessed circumferential wall portion extending upward from an inner end part in the bottle radial direction of the movable wall portion, wherein:

the movable wall portion is arranged to be movable upward together with the recessed circumferential wall portion, around a connected portion with the rising circumferential wall portion, the recessed circumferential wall portion is connected to the movable wall portion through a bent part bent upward from the inner end part in the bottle radial direction of the movable wall portion, the movable wall portion before pressure reduction inside the bottle extends such that a separation between the movable wall portion and a plane perpendicular to the central axis and positioned above the movable wall portion gradually increases from the upper end part of the rising circumferential wall portion to the bent part, or extends parallel to the plane, the bent part before pressure reduction inside the bottle is located to be lower than or equal to the upper end part of the rising circumferential wall portion, a plurality of ribs are arranged in the movable wall portion radially around the central axis, the recessed circumferential wall portion is provided with no ribs, and a ratio of a width of each rib in a circumferential direction around the central axis, to a circumferential length of an outermost portion in the radial direction between ribs adjacent to each other in the circumferential direction in the movable wall portion, is larger than or equal to 0.12.

2. The bottle according to claim 1, wherein each rib extends discontinuously in the bottle radial direction.

3. The bottle according to claim 1, wherein each rib is formed in a concave shape recessed upward.

4. The bottle according to claim 2, wherein each rib is formed in a concave shape recessed upward.

5. A bottle formed of synthetic resin materials in a cylindrical shape with a bottom, the bottle comprising:

a bottom wall portion in a bottom portion thereof including:

a grounding portion positioned at an outer circumferential edge thereof;

a rising circumferential wall portion connected to the grounding portion from inside thereof in a bottle radial direction orthogonal to a central axis of the bottle, the rising circumferential wall portion extending upward;

a movable wall portion protruding from an upper end part of the rising circumferential wall portion toward the central axis; and an annular recessed circumferential wall portion extending upward from an inner end part in the bottle radial direction of the movable wall portion, wherein:

the movable wall portion is arranged to be movable upward together with the recessed circumferential wall portion, around a connected portion with the rising circumferential wall portion, the recessed circumferential wall portion is connected to the movable wall portion through a bent part bent upward from the inner end part in the bottle radial direction of the movable wall portion, the movable wall portion before pressure reduction inside the bottle extends such that a separation between the movable wall portion and a plane perpendicular to the central axis and positioned above the movable wall portion gradually increases from the upper end part of the rising circumferential wall portion to the bent part, or extends parallel to the plane, the bent part before pressure reduction inside the bottle is located to be lower than or equal to the upper end part of the rising circumferential wall portion, a plurality of ribs are arranged in the movable wall portion radially around the central axis, and the recessed circumferential wall portion is provided with no ribs.

* * * * *